US006851363B2

(12) United States Patent
Schneider

(10) Patent No.: US 6,851,363 B2
(45) Date of Patent: Feb. 8, 2005

(54) SHORT INKING UNIT FOR A ROTARY PRINTING MACHINE AND METHOD OF IMPROVING THE INK SPLITTING IN SUCH A SHORT INKING UNIT

(75) Inventor: Josef Schneider, Diedorf (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/153,325

(22) Filed: May 22, 2002

(65) Prior Publication Data

US 2002/0174786 A1 Nov. 28, 2002

(30) Foreign Application Priority Data

May 23, 2001 (DE) ..... 101 25 257

(51) Int. Cl.[7] ..... B41F 31/00; B41F 31/18

(52) U.S. Cl. ..... 101/352.11; 101/350.1

(58) Field of Search ..... 101/130, 348, 101/349.1, 350.1, 352.11, 450.1, 478, 483, 489

(56) References Cited

U.S. PATENT DOCUMENTS

| | | | | | |
|---|---|---|---|---|---|
| 4,610,201 | A | * | 9/1986 | Jeschke | 101/217 |
| 4,833,990 | A | | 5/1989 | Hirt et al. | 101/130 |
| 5,018,445 | A | * | 5/1991 | Six | 101/489 |
| 5,132,706 | A | * | 7/1992 | Yuasa et al. | 346/140.1 |
| 5,138,345 | A | * | 8/1992 | Tohyama et al. | 346/140.1 |
| 5,454,318 | A | | 10/1995 | Hirt et al. | 101/453 |
| 5,580,688 | A | | 12/1996 | Hirt | 430/35 |
| 5,829,355 | A | * | 11/1998 | Spengler | 101/489 |
| 5,927,206 | A | * | 7/1999 | Bacon et al. | 101/453 |
| 5,937,750 | A | * | 8/1999 | Takeda | 101/116 |
| 2002/0014171 | A1 | | 2/2002 | Konrad et al. | 101/350.1 |

FOREIGN PATENT DOCUMENTS

| | | | | |
|---|---|---|---|---|
| JP | 08090760 | A | * 4/1996 | B41F/31/02 |

* cited by examiner

*Primary Examiner*—Andrew H. Hirshfeld
*Assistant Examiner*—Leo T. Hinze
(74) *Attorney, Agent, or Firm*—Cohen, Pontani, Lieberman & Pavane

(57) ABSTRACT

Inking unit rolls include at least one ink applicator roll, which rotates in an ink fountain filled with printing ink and picks up printing ink from the latter, and a plate cylinder, which serves as a printing plate carrier and onto which ink can be transferred, directly or indirectly, by the ink applicator roll. The short inking unit is therefore equipped with a small number of inking unit rolls and, at the same time, nevertheless ensures a uniform, homogeneous application of ink to the plate cylinder, that is to say the ink splitting on ink-carrying rolls of a short inking unit for a rotary printing machine is improved. At least one of the inking unit rolls is provided, at least on its surface, with a coating having powerful microdipoles, in particular made of ferroelectric material. This circumferential surface is assigned electric means in order to produce an electric field by means of a DC/AC voltage, in order to polarize and depolarize the microdipoles of the circumferential surface in the form of a homogeneous or periodic charge image, so that an ink layer resting on it is given a desired electric roughness.

18 Claims, 2 Drawing Sheets

SHORT INKING UNIT FOR A ROTARY PRINTING MACHINE AND METHOD OF IMPROVING THE INK SPLITTING IN SUCH A SHORT INKING UNIT

BACKGROUND OF THE INVENTION

1. Field of the Invention

The invention relates to a short inking unit for a rotary printing machine, and to a method of improving the ink splitting in such a short inking unit.

2. Description of the Related Art

For the purpose of inking plate cylinders in web-fed or sheet-fed offset printing machines, use is made of inking units, generally ductor inking units in sheet-fed offset printing and ductor-less film inking units in web-fed offset printing. As is known, such inking and damping-roll arrangements comprise a large number of rolls for the supply and metering of the ink, rolls for the spreading/distribution of the ink and transport of the ink by means of ink splitting and ink application to the printing plate. These "long" inking units, as they are known, permit frequent splitting and distribution of the conveyed ink layer, so that after the ink applicator rolls, a smooth thin ink film is produced.

Critical parameters for the ink transfer by means of ink splitting are molecular, physical interface effects such as cohesion and adhesion forces, surface tension, wetting, which interact closely.

At each roll contact, the ink film thickness is divided. In simplified form, the complex theory of ink splitting states that: if two rolls roll on each other, only one of which is inked, then the printing ink is distributed in a specific ratio onto both roll surfaces. The aim of the ink transfer is a uniform distribution of the printing ink picked up by the ink ductor or the film roll and optimum inking of the printing plate.

As a result of the large number of rolls, the intention is therefore to ensure good distribution of the printing ink on the plate cylinder and to produce an ink layer of defined thickness on the plate cylinder, the ink layer having a high uniformity even in continuous printing; faults which are inherent in the system, such as ghosting behavior, are intended to be attenuated in this way. The number and circumference of the ink applicator rolls have an important influence on the uniform inking of the printing plate. It is simpler to apply a thin ink film to the printing plate successively from a plurality of ink applicator rolls and to smooth this film, than to apply the same quantity of ink with fewer rolls. However, as a result of the large number of rolls, the inking unit becomes more complicated.

A further problem is the filling characteristic of the inking unit; the more ink applicator and ink transfer rolls the inking unit has, the longer the time taken until the ink applicator rolls discharge the desired quantity of ink to the plate cylinder, so that a large amount of waste is produced until the inking unit has reached its steady state.

Short inking units are also used in web-fed offset printing machines for newspaper printing. Short inking units have already been known for a long time, for example see U.S. 2002/0014171. These inking units have a small number of rolls. Because of the small number of splitting points for the ink splitting between the rolls, the resultant disadvantage is that the printing ink can only poorly be emulsified with the damping solution. Furthermore, the consistency of the ink is destroyed by excessive splitting back of ink into the ink fountain. This often leads to a cloudy image and a disrupted ink and water equilibrium. Current short inking units also have very few possibilities in layer thickness variation.

On the other hand, in the case of digital printing machines in particular, it is desirable to carry out actions to optimize the printing quality, primarily in the digital data set, without influencing the mechanical components within the printing machine, such as is done for example by setting screws or by means of run-up curves. In a printing machine of this type, oriented towards the image data, the actions are therefore carried out in the data at the prepress stage or in the raster image processor (RIP). An inking unit to be developed for such a printing machine must therefore be stable in terms of its characteristic curve, in order that compensation for printing-unit-specific faults when setting an image can be made by influencing the digital data, and the printing quality does not change in continuous printing either.

However, if inking units have few splitting points, then because of the low layer thickness equalization, an irregular course of the optical density in the printing direction occurs, which is visually perceptible in the case of high quality requirements.

In addition, in an ink supply to the ink applicator roll, if there are changes in the damping solution proportion in the splitting points which lie in the ink stream, ink splitting conditions are changed. If the damping solution proportion in the splitting points in the ink stream change as a result of a change in the damping solution feed by a damping unit, in particular in the case of damping directly into the inking unit, the ink supply has to be readjusted in order to obtain the same ink application to the printing plate. This should be avoided.

If the damping solution proportion in the splitting points of the ink stream changes because of a different quantity of damping solution on the printing plate, caused by the distribution of printing and non-printing proportions of the area, pulsations are produced in the ink stream, by which ghosting is caused.

U.S. Pat. No. 5,580,688 discloses a digital printing process using a short inking unit in which, in order to duplicate an original image, the printing plate has on the surface a layer of a ferroelectric material, which may be polarized differently in very small regions.

The printing plate is polarized by there being an electric DC voltage on an electrode and an electrically conductive layer, for example the metallic roll itself, serving as a mating electrode underneath the ferroelectric material. Conversely, the printing plate may be depolarized again by means of an AC voltage, whose frequency lies far above the resonant frequency of the ferroelectric, or by heating to a temperature above the Curie temperature or, by means of subsequent application of a DC voltage, may be polarized uniformly again.

The function, and also the behavior of ferroelectric material under the action of electric fields, and also in the case of energy supply by means of heat, are extensively described in U.S. Pat. No. 5,580,688. Furthermore, the digital production of an erasable printing plate, on which hydrophobic and hydrophilic regions can be displayed and which contains a material with ferroelectric properties is disclosed by U.S. Pat. No. 5,454,318.

SUMMARY OF THE INVENTION

It is the object of the invention to provide a short inking unit for a rotary printing machine having a low number of inking unit rolls and, at the same time, to ensure uniform, homogeneous ink application to the plate cylinder, that is to say to improve the ink splitting on ink-carrying rolls of a short inking unit for a rotary printing machine.

According to the invention, a short inking unit for a rotary printing machine has at least one applicator roll, which rotates in an ink fountain filled with printing ink and picks up printing ink from the latter, and a plate cylinder as a further inking unit roll, which serves as a printing plate carrier and onto which printing ink can be transferred by the applicator roll. At least one of these inking unit rolls is provided, at least on its circumferential surface, with a coating having powerful microdipoles, in particular made of ferroelectric material, and such a circumferential surface is assigned means in order to produce an electric field by means of a DC/AC voltage, in order to polarize and to depolarize the microdipoles of the circumferential surface in the desired way.

DETAILED DESCRIPTION OF THE PRESENTLY PREFERRED EMBODIMENTS

According to the invention, the ink splitting in such a short inking unit is improved in that, by means of the means associated with a circumferential surface having a coating with powerful microdipoles, a sporadic voltage excitation to produce a charge image is brought about. In this way a certain electric roughness of the ink layer resting on the circumferential surface is produced, until this leads to activation of the splitting process. As a result of the sporadic voltage excitation, orange peel, as it is known, can be observed on the surface of the ink layer resting on it, that is to say the lattice constant of the molecular arrangement on the surface of the ink layer, that is to say the critical parameter for the ink transfer by means of ink splitting, like molecular, physical interface effects, are influenced, so that in other words the properties of the splitting points of the short inking unit involved in the transfer chain of the printing ink can be influenced positively with the effect of accelerating the conditioning of the printing ink for a good distribution of the printing ink on the printing plate.

Figure 1:
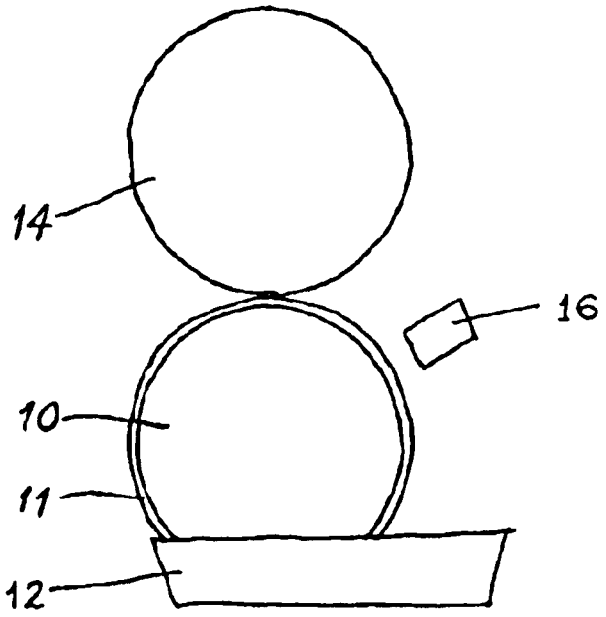
FIG. 1 is a diagrammatic side view of a first embodiment of apparatus for practicing the invention.

FIG. 1 shows an applicator roll 10 which rotates in an ink fountain 12, the roll having a coating 11 of powerful microdipoles of ferroelectric material. In order to polarize the microdipoles of the coating 11 in a desired way, an imaging unit 16 produces an, electric field which brings about a time-sporadic voltage excitation of the microdipoles. The sporadic voltage excitation is carried out until a desired electric roughness or lattice constant of the ink layer is achieved, which in turn effects a desired transfer or splitting of ink between the applicator roller 10 and a printing plate cylinder 14 which follows.

The cyclic or chronological sequence of the sporadic voltage excitation must be determined empirically or in accordance with a characteristic curve.

A short inking unit designed in accordance with the invention therefore permits the improvement of the ink splitting with only a few splitting points in an electrical way, without having to fall back on mechanical means on ink-carrying rolls in inking units, but also during the use of a damping solution from a damping unit likewise on rolls belonging to the damping unit.

Expressed in general terms, by means of the charge image produced by means of the time-sporadic voltage excitation of the microdipoles of a circumferential surface of a roll, a plurality of rolls for ink splitting are replaced or simulated, since the electric roughness of the ink film resting on them influences the properties of the ink or of the ink/damping solution emulsion in such a way that the affinity for the next roll of the ink enriched with damping solution is increased or the splitting process is activated in such a way that ghosting no longer occurs or is at least moderated to a great extent. By means of the sporadic voltage excitation, the ink layer thickness of the printing ink transferred can be regulated in the short inking unit.

As a result of the inking unit roll surface being polarized uniformly or provided with a periodic polarization pattern (for example in a similar way to the image-based polarization of a printing plate coated with ferroelectric material), no current flow is produced there (keyword: blocking contacts), so that electrochemical changes (such as galvanic processes) do not take place.

In addition, in particular in the case of large-circumference inking unit rolls, the ink transfer and splitting may be optimized further by it being possible for the "electrostatic roughening" of the ink layer resting on the circumferential surface even to be carried out on the basis of a printing image charge (correlated with a printing image), that is to say with a differentiation in image and non-image regions on the circumferential surface of the inking unit roll (for example in the case of applying different polarization intensities, local frequencies and the like). The action of this measure corresponds to the known dynamic zone regulators, as they are known, belonging to a device for metering the quantity of ink in the inking unit, which are likewise also able to meter in the circumferential direction of the inking unit roll, not just in a strip-like manner but also variably. According to the invention, this mechanical device can now be simulated or replaced by electronic means.

In this way, a short inking unit for a rotary printing machine is made possible which provides the same quality with respect to the ink splitting as a "long" inking unit having a large number of rolls for the supply and metering of the ink, rolls for the spreading/distribution of the ink and transport of the ink and ink application to a printing plate.

Ferroelectrics or suitable materials with ferroelectric properties are, for example, inorganic ceramic materials, such as barium titanate, lead zirconate and mixed structures thereof, or organic substances, such as polyvinylidene fluoride with C—F chains as elementary dipoles. If an electric field is applied, then above a certain material-dependent field strength, the coercive field strength, as it is known, the dipoles not standing in the field direction are turned over in the field direction and remain in this state even after the electric field is switched off. This procedure is referred to as polarization of the ferroelectric. Of course, using the current image-setting devices, this can be managed right down to the very smallest image regions.

The short inking unit created by the invention does not have any inking zones, as a result of which it is simple to operate; in addition, ghosting is avoided with simple means. When a damping solution is used, a stable ink-water equilibrium may be achieved, although fewer rolls are used. Therefore, an inking quality which is stable and uniform over time, over the width of the printing plate and over its entire area is achieved. The inking unit is constructed simply, the number of operating elements is reduced to a minimum.

The short inking unit is suitable both for indirect and for direct printing. It may be used in printing processes in which a damping solution is used and in printing processes which operate without water.

A short inking unit for an offset printing machine has an applicator roll which rotates in an ink fountain filled with printing ink and picks up printing ink from the latter. The ink applicator roll transfers the printing ink to a plate cylinder, which is provided with at least one printing plate. In the case of indirect printing, the plate cylinder co-operates with a transfer cylinder (rubber-covered cylinder). In the case of direct printing, to which the short inking units described below can likewise be applied, the transfer cylinder is omitted.

Figure 2:
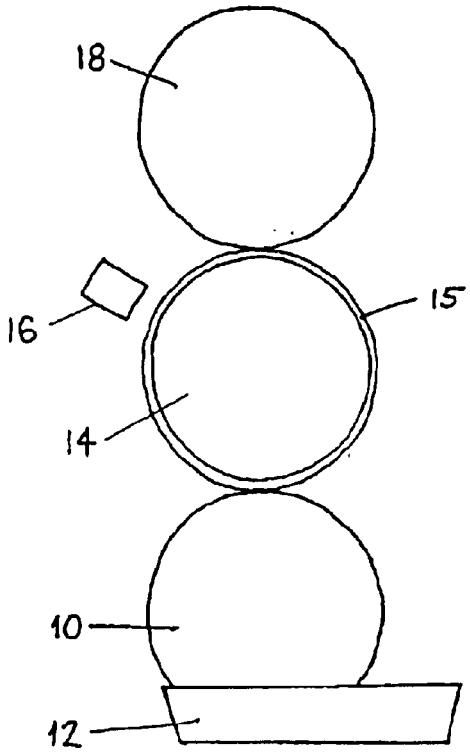
FIG. 2 is a diagrammatic view of a second embodiment of apparatus for practicing the invention.

FIG. 2 shows an applicator roll 10 which rotates in an ink fountain 12, and a printing plate cylinder 14 having a coating 15 of powerful microdipoles of ferroelectric material. In order to polarize the microdipoles of the coating 15 in a desired way, an imaging unit 16 produces an electric field which brings about a time-sporadic voltage excitation of the microdipoles. The sporadic voltage excitation is carried out until a desired electric roughness or lattice constant of the ink layer is achieved, which in turn effects a desired transfer or splitting of ink between the printing plate cylinder 14 and a transfer cylinder 18 which follows.

In order to reduce waste, to improve the printing quality and to simplify operation, it is particularly advantageous if the printing ink is present in preconditioned form in the ink fountain. This means that an emulsion of the printing ink and a damping solution or a release agent is already supplied into the ink fountain, having been mixed with the printing ink outside the ink fountain, either by means of a stirrer or by means of ultrasound. As a result, the development of heat within the ink fountain as a result of the emulsification is avoided.

The measures according to the invention make it possible to provide ink layer thicknesses of different thicknesses for enhanced quality demands. All the faults and disadvantages specific to an inking unit and known from long inking units are dispensed with or eliminated by the short inking unit.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A short inking unit for a rotary printing machine, said short inking unit comprising a plurality of inking unit rolls comprising at least one ink applicator roll which rotates in an ink fountain filled with printing ink and picks up printing ink from said fountain, and a plate cylinder having a printing plate onto which ink can be transferred from said ink applicator roll, each of said inking unit rolls having a circumferential surface which carries an ink layer, a coating having microdipoles provided on one of said circumferential surfaces, and electric means for producing a sporadic DC voltage excitation for producing an electric field which polarizes said microdipoles to a desired extent so that a desired surface roughness of said ink layer on said one of said circumferential surfaces is obtained, and for producing an AC voltage for producing an electric field which depolarizes said microdipoles, whereby said polarized and depolarized microdipoles produce a charge image which permits a desired amount of ink to be transferred from said one of said circumferential surfaces to another one of said circumferential surfaces.

2. A short inking unit as in claim 1 wherein said coating comprises a ferroelectric material which contains said microdipoles.

3. A short inking unit as in claim 2 wherein said AC voltage has a frequency which lies above the resonant frequency of the ferroelectric material.

4. A short inking unit as in claim 1 further comprising a damping unit comprising a damping roll and a damping solution, said coating containing said powerful microdipoles being provided on said damping roll.

5. A short inking unit as in claim 1 further comprising a transfer cylinder which cooperates with said plate cylinder for printing.

6. A short inking unit as in claim 1, wherein said ink applicator roll transfers ink directly to said plate cylinder.

7. A short inking unit as in claim 6, wherein said coating is provided on the circumferential surface of the ink applicator roll.

8. A short inking unit as in claim 6, wherein said coating is provided on the circumferential surface of the plate cylinder, said inking unit further comprising a transfer cylinder, said plate cylinder transferring ink directly to said transfer cylinder.

9. A method of improving ink splitting in short inking unit comprising a plurality of inking unit rolls comprising at least one ink applicator roll which rotates in an ink fountain filled with printing ink and picks up printing ink from said fountain, and a plate cylinder having a printing plate onto which ink can be transferred from said ink applicator roll, each of said inking unit rolls having a circumferential surface which carries an ink layer, a coating having microdipoles provided on one of said circumferential surfaces, said short inking unit further comprising electric means for producing a sporadic DC voltage for producing an electric field which polarizes said microdipoles, and for producing an AC voltage for producing an electric field which depolarizes said microdipoles, said method comprising carrying out a sporadic voltage excitation by means of said electric means to produce a charge image on the one of said circumferential surfaces in such a way that a desired surface roughness of the ink layer on the one of circumferential surfaces is produced, whereby a desired amount of ink can be transferred from said one of said circumferential surfaces to another one of said circumferential surfaces.

10. A method as in claim 9 wherein said ink layer on said printing plate has a thickness, said method further comprising regulating the thickness of the ink layer on the printing plate by said sporadic voltage excitation.

11. A method as in claim 9 wherein said sporadic voltage excitation is carried out in a manner correlated with the printing image so that the electric roughness of the ink layer is correlated with the printing image and the circumferential surface to which the ink is transferred can be inked in a manner corresponding with the printing image.

12. A method as in claim 9 wherein said sporadic voltage excitation is carried out in a chronological sequence which is determined empirically.

13. A method as in claim 12 wherein said chronological sequence is cyclic.

14. A method as in claim 9 wherein said sporadic voltage excitation is carried out in a chronological sequence which is determined in accordance with a characteristic curve.

15. A method as in claim 14 wherein said chronological sequence is cyclic.

16. A method as in claim 9 wherein said sporadic voltage excitation is carried out until the desired surface roughness of the ink layer is obtained.

17. A method as in claim 9 wherein said coating is applied to said ink applicator roll, said sporadic voltage excitation being carried out on said circumferential surface of said ink applicator roll.

18. A method as in claim 9, wherein said coating is applied to said printing plate cylinder, said sporadic voltage excitation being carried out on said circumferential surface of said printing plate cylinder.

* * * * *